US012528112B2

(12) United States Patent
De Sutter

(10) Patent No.: US 12,528,112 B2
(45) Date of Patent: Jan. 20, 2026

(54) PLATE HOLDER FOR PERFORATION PRESS AND METHOD FOR MOVING PLATE HOLDER

(71) Applicant: Soenen Technology NV, Roeselare (BE)

(72) Inventor: Luc De Sutter, Roeselare (BE)

(73) Assignee: Soenen Technology NV, Roeselare (BE)

( * ) Notice: Subject to any disclaimer, the term of this patent is extended or adjusted under 35 U.S.C. 154(b) by 546 days.

(21) Appl. No.: 18/063,127

(22) Filed: Dec. 8, 2022

(65) Prior Publication Data

US 2023/0182194 A1 Jun. 15, 2023

(30) Foreign Application Priority Data

Dec. 10, 2021 (BE) ..... 2021/5964

(51) Int. Cl.
*B21D 28/26* (2006.01)
*B21D 43/02* (2006.01)

(52) U.S. Cl.
CPC ..... *B21D 28/26* (2013.01); *B21D 43/02* (2013.01)

(58) Field of Classification Search
CPC ..... B21D 28/26; B21D 43/02
See application file for complete search history.

(56) References Cited

U.S. PATENT DOCUMENTS

| | | | | |
|---|---|---|---|---|
| 2019/0283105 | A1* | 9/2019 | Moriyasu | B30B 15/30 |
| 2020/0277148 | A1* | 9/2020 | Seif | B65G 57/035 |
| 2022/0001433 | A1* | 1/2022 | Lin | B23P 19/001 |
| 2023/0182194 | A1* | 6/2023 | De Sutter | B21D 28/26 83/30 |
| 2023/0311441 | A1* | 10/2023 | Nakashima | B21D 28/02 72/419 |
| 2023/0347404 | A1* | 11/2023 | De Sutter | B21D 28/243 |
| 2023/0356281 | A1* | 11/2023 | De Sutter | B26D 5/00 |

* cited by examiner

*Primary Examiner* — Omar Flores Sanchez
(74) *Attorney, Agent, or Firm* — Vorys, Sater, Seymour and Pease LLP

(57) ABSTRACT

The present invention relates to a perforating press for perforating sheet material comprising a feeder; a punch holder comprising a first and a second row of punches; a transmission shaft for moving the punch holder in a stroke direction, wherein a set of slides is positioned between each row of punches and the transmission shaft, wherein a set of slides comprises two slides, wherein a slide comprises on a first side an at least partially continuous sawtooth profile, wherein the two slides of a set of slides are positioned with their sawtooth profiles slidably on top of each other; and a discharge means; wherein the punch holder comprises a third and a fourth row of punches and wherein the slides of a set of slides related to any one row of punches are slidable between at least three positions relative to each other independently from the slides of a set of slides related to any other row of punches. The invention also relates to a method and a use.

15 Claims, No Drawings

PLATE HOLDER FOR PERFORATION PRESS AND METHOD FOR MOVING PLATE HOLDER

FIELD OF THE INVENTION

The invention relates to a perforating press, more in particular a perforating press for perforating sheet material and a method for perforating sheet material. The invention also relates to a use of the perforating press or the method for manufacturing grids for household appliances.

BACKGROUND

Perforating presses for perforating sheet material are known from the prior art. In known perforating presses, sheet material is fed into a perforating press according to a first direction, after which perforations are made in the sheet material with the aid of a punch holder with punches. The punch holder is moved up and down by a transmission shaft, causing the punches to periodically perforate the sheet material. By moving the sheet material according to the first direction during a period when the punches are not in contact with the sheet material, it is possible to apply a perforation pattern in the sheet material.

Successive lines of a perforation pattern are often different, for example, perforations of successive lines are offset from each other according to a second direction, transverse to the first direction. In addition, it is also possible that successive lines of the perforation pattern lie closer together than rows of punches can be placed in a punch holder. To solve these problems, punch holders with two rows of punches are used. A first row comprises the punches for perforating a first line of the perforation pattern and a second row comprises the punches for a second line. For example, the very first line of the perforation pattern is applied using only the first row of punches and the very last line is applied using only the second row of punches. Between the very first and the very last line of the perforation pattern, both rows of punches are used each time. However, the transmission shaft of the perforating press will always move both rows of punches up and down.

To still be able to engage or disengage the punches of a row, two sets of slides are placed between the transmission shaft and a punch holder with two rows of punches. Slides are beam-shaped steel elements that extend according to the second direction, with a sawtooth profile on one side. By aligning two slides with their sawtooth profile facing each other and placed on top of each other, it is possible to obtain a different height for each set of two slides by sliding the two slides relative to each other according to the second direction. This will cause the punches of a punch holder to move up and down more or less and may or may not cause perforations in the sheet material.

These well-known perforating presses have the disadvantage that only a limited number of variations in perforation patterns can be realized. Local deviations in an otherwise regular perforation pattern are very difficult to realize in a performant way due to the limited control possibilities of the perforating press. Another known problem is that the relative sliding of the slides of a set of slides is slow, so that the transmission shaft of a perforating press has to be temporarily stopped by means of a clutch brake in order to engage or disengage a row of punches from the punch holder. This reduces the productivity of the perforating press and the constant starting and stopping of the transmission shaft is also energetically unfavourable and imposes heavy mechanical loads on the perforating press.

CN 204 770 147 U (CN '147) describes an assembly of a punch holder, die and punches. CN '147 does not describe a punch press.

DE 196 22 843 A1 (DE '843) discloses a perforating press with a single row of punches that can be individually selected using a complex mechanism.

The present invention seeks to solve at least some of the above-mentioned problems or drawbacks.

SUMMARY OF THE INVENTION

In a first aspect, the present invention relates to a perforating press according to claim 1.

Advantageously, the perforating press comprises a punch holder, wherein the punch holder comprises four rows of punches, a set of slides being positioned between each row of punches and the transmission shaft. The slides of a set of slides related to any one row of punches are slidable relative to each other independently from the slides of a set of slides related to any one other row of punches. As a result, each row of punches can be individually switched on or off, allowing more flexibility in the application of a perforation pattern and locally deviating from an otherwise regular perforation pattern by switching other rows of punches on or off. Particularly advantageous is that the slides of a set of slides are slidable between at least three positions relative to each other. By using punches of different lengths, it is now possible to deviate from an otherwise regular perforation pattern even within a single line. An additional advantage of using four rows of punches is that successive lines of the perforation pattern can be applied very close to each other.

Preferred embodiments of the device are shown in claims 2 to 9.

In a specific preferred embodiment the invention concerns a device according to claim 5.

By using a predetermined volume of oil to move the first hydraulic cylinder, it is possible to correctly move the second slide very quickly. The predetermined volume of oil can be injected under high pressure from a storage buffer into the first hydraulic cylinder at once. Because the volume is predetermined, a distance over which the second slide is slid according to the second direction is by this also known in advance. It is not necessary to gradually inject oil into the first hydraulic cylinder in order to avoid the second slide being slid too far according to the second direction.

In a second aspect, the present invention relates to a method according to claim 10, one advantage of the present method being that during the perforation of the sheet material, at least four rows of punches. are used, whereby slides of at least one set of slides related to any one row of punches are slid independently of the slides of a set of slides related to any one other row of punches between at least three positions relative to each other, very many variations of perforation patterns can be applied in the sheet material and that very flexibly a local deviation from an otherwise regular perforation pattern can be made, even within one line of the perforation pattern. An additional advantage of the method is that the use of at least four rows of punches allows successive lines of a perforation pattern to be applied very close together.

Preferred embodiments of the method are described in claims 11 to 14.

In a third aspect, the present invention relates to a use according to claim 15. This use results in the advantageous manufacture of grilles for household appliances, such as, for example, grilles in doors of microwave ovens, grilles over a drain in dishwashers or cooling grilles in, for example, computer casings. In household appliances, grilles often incorporate decorative elements such as, for example, a logo or a variation in density in perforations. The use of a perforation grid according to the first aspect or a method according to the second aspect allows to performantly realize a large variety of perforation patterns or to deviate locally from an otherwise regular perforation pattern, for example for a logo. These grids also often have a very small gap between consecutive lines of a perforation pattern, which is perfectly possible due to the four rows of punches.

DETAILED DESCRIPTION

Unless otherwise defined, all terms used in the description of the invention, including technical and scientific terms, have the meaning as generally understood by those skilled in the technical field of the invention. For better assessment of the description of the invention, the following terms are explicitly explained.

"A," "the," and "the" refer to both singular and plural in this document unless the context clearly assumes otherwise. For example, "a segment" means one or more than one segment.

The terms "comprise", "encompass", "consist of", "provide with", "contain" are synonyms and are inclusive or open-ended terms that indicate the presence of what follows, and do not exclude or preclude the presence of other components, features, elements, members, steps, known from or described in the prior art.

Citing numeric intervals through the endpoints comprises all integers, fractions and/or real numbers between the endpoints, these endpoints comprise.

In a first aspect, the invention relates to a perforating press for perforating sheet material.

According to a preferred embodiment, the perforating press comprises a feeding means for feeding sheet material in a first direction, a punch holder, wherein the punch holder comprises a first row of punches, a second row of punches, a third row of punches and a fourth row of punches, a transmission shaft for moving the punch holder in a stroke direction, and a discharge means for discharging perforated sheet material.

The first direction is preferably a horizontal direction. The sheet material is preferably supplied to the perforating press in a horizontal plane.

The feeding means may be a table equipped with conveyor belts, transport belts, transport wheels, transport rollers or any other suitable means for moving sheet material in the first direction. A table is advantageous in case the sheet material consists of individual sheets.

The feeding means may be a powered uncoiler suitable for uncoiling sheet material from a coil, for example a steel coil. The sheet material is fed directly from the roll. Optionally, the perforating press comprises a cutting device for cutting unrolled sheet material into individual sheets and the sheet material is supplied as individual sheets. In this case, as previously described, the perforating press may also comprise a table as a feeding device. Optionally, the perforating press comprises means for flattening the unrolled sheet material prior to perforating, such as, for example, straightening rollers.

The feeding means is preferably suitable for feeding sheet material with a width, measured transverse to the first direction of at least 100 mm and at most 2000 mm, preferably at most 1900 mm, more preferably at most 1800 mm and even more preferably at most 1700 mm.

The perforated sheet material is preferably discharged according to the first direction.

The discharge means may be a table equipped with conveyor belts, transport belts, transport wheels, transport rollers or any other suitable means for moving sheet material.

In the case where the sheet material is supplied directly from a roll, the discharge means may be a powered reeling reel suitable for reeling the perforated sheet material into a roll. Alternatively, the perforating press comprises a cutting device for cutting the perforated sheet material into individual sheets. In this case, as previously described, the perforating press may also comprise a table as a discharging device.

The first row of punches, the second row of punches, the third row of punches and the fourth row of punches extend in a second direction. The second direction is transverse to the first direction. Preferably, the second direction is horizontal. The first row of punches, the second row of punches, the third row of punches and the fourth row of punches each comprise at least two punches. The punches are tools suitable for perforating sheet material by moving the punch holder in the stroke direction whereby the punches are pushed through the sheet material. The striking direction is transverse to the first direction and transverse to the second direction. The striking direction is preferably a vertical direction. Preferably, the punches comprised in the punch holder are interchangeable. In this case, a punch holder comprises openings for inserting punches. The punches have a circular, hexagonal or other suitable cross section, depending on a desired perforation. Punches comprised in a punch holder may have either equal or different dimensions, depending on a desired perforation pattern. Punches comprised in a punch holder are preferably arranged on a line according to the second direction. The punch holder preferably extends across the full width of the fed sheet material. This is advantageous to be able to punch the fed sheet material over the full width. It is apparent to one skilled in the art that the number of punches comprised in a punch holder depends on the desired perforation pattern and a desired width over which the fed sheet material is to be perforated. It is also clear to one skilled in the art that in the case of interchangeable punches, it is not necessary to have a punch placed in every hole in a punch holder for placing punches. According to the second direction, the punch holder extends over at least 1000 mm, preferably at least 1250 mm, more preferably at least 1500 mm and even more preferably at least 1600 mm.

A set of slides is placed between each row of punches comprised in the punch holder and the transmission shaft. A set of slides comprises two slides. A slide is beam-shaped. The beam shape extends according to a length direction, a width direction and a height direction. The beam shape has a greatest dimension according to the length direction. The length direction of the beam form corresponds to the second direction. Thus, a slide extends according to the second direction. A slide comprises on a first side a sawtooth profile at least partially continuous according to the second direction. By at least partially continuous is meant that the saw tooth profile extends along at least a portion of the length of the beam shape according to the length direction of the beam shape. The saw tooth profile is continuous along at least 50% of the length of the beam shape, preferably along at least 60% of the length of the beam shape, more preferably along at least 70% of the length of the beam shape, even more preferably along at least 80% of the length of the beam shape, and even more preferably along at least 90% of the length of the beam shape.

A tooth of the sawtooth profile has two sides with different slopes. The sawtooth profile is similar to the profile of a northlight roof. The two slides of a set of slides are positioned with their sawtooth profiles on top of each other slidably relative to each other according to the second direction. This means that a first slide of a set of slides is slidable, making the two slides slidable with respect to each other, or that a second slide of a set of slides is slidable, making the two slides slidable with respect to each other, or that the first and second slide are slidable, making the two slides slidable with respect to each other. The sawtooth profiles of the two slides face each other according to the stroke direction. The slides of a set of slides related to any one row of punches are slidable between at least three positions relative to each other independently from the slides of a set of slides related to any other row of punches. That a set of slides is related to a row of punches means that the set of slides is positioned between the transmission shaft and the row of punches according to the stroke direction, and that the row of punches is moved in an active state in the stroke direction by the transmission shaft with the punch holder in the stroke direction with the aid of said set of slides. That the slides of a set of slides are slidable between at least three positions means that the two slides of a set of slides have at least three stable positions relative to each other.

The sawtooth profile is advantageous for enabling or disabling punches in a punch holder of a perforating press. As the two slides of a set of slides are facing each other with their saw tooth profile and are placed on top of each other, a beam-shaped element with a certain height is obtained. By sliding the two slides relative to each other, the height of the beam-shaped element is adjusted. The height is according to the stroke direction. Punches comprised in a punch holder are moved together with the punch holder by a set of slides through the transmission shaft in the stroke direction. Depending on the height of the beam-shaped element formed by the set of slides, the punches are moved in an active state further or less far according to the stroke direction to the sheet material, which determines whether or not a punch is pushed through the sheet material and the sheet material is perforated by the punches or not. Because the slides of a set of slides related to any one row of punches are slidable relative to each other independently of the slides of a set of slides related to any other row of punches, each row of punches can be individually engaged or disengaged, thus allowing greater flexibility in the application of a perforation pattern and locally deviating from an otherwise regular perforation pattern by engaging or disengaging other rows of punches. Particularly advantageous is that the slides of a set of slides are slidable between at least three positions relative to each other. By using punches of different lengths, it is now possible to deviate from an otherwise regular perforation pattern even within a single line. For example, in a row of punches, punches of two different lengths are used, where in a first position relative to each other of the two slides of the set of slides, related to said row of punches, all punches comprises in the row perforate the sheet material, where in a second position relative to each other of said two slides, only punches of greatest length comprised in the row of punches perforate the sheet material, and where in a third position relative to each other of said two slides, no punches comprised in the row of punches perforate the sheet material. In the third position, the punches are disabled. In the first position, the beam-shaped element formed by the set of slides has the largest height, in the third position the beam-shaped element has the smallest height, and in the second position the beam-shaped element has an intermediate height. An additional advantage of using four rows of punches is that successive lines of the perforation pattern can be applied very close together.

According to a preferred embodiment, the slides of a set of slides are slidable between four positions relative to each other. This means that the two slides of a set of slides have at least four stable positions relative to each other. This is advantageous because it allows punches of three different lengths to be used in a punch holder, thus providing more flexibility to deviate from an otherwise regular perforation pattern within a single line.

According to a further embodiment, at least one of the rows of punches comprises at least three punches of different length each. There is at least one first punch having a longest length, at least one second punch having a shortest length and at least one third punch having an intermediate length. The length of a punch is measured according to the stroke direction from the same surface of the punch holder to a free end of the punch. This form of implementation is highly advantageous for maximum flexibility to deviate from an otherwise regular perforation pattern within a single line.

In a first position relative to each other of the two slides of the set of slides, related to said row of punches, all punches comprised in the row of punches perforate the sheet material. In a second position relative to each other of said two slides perforate only first and third punches comprised in the row of punches the sheet material. In a third position relative to each other of said two slides only first punches comprised in the row of punches perforate the sheet material. In a fourth position relative to each other of said two slides no punches comprised in the row of punches perforate the sheet material. In the fourth position, the row of punches is disabled. The height according to the stroke direction of the beam-shaped element formed by the set of slides gradually decreases from the first position to the fourth position.

According to a preferred embodiment, a first slide of a set of slides is preloaded against a second slide of the set of slides using springs. The first slide is preferably the slide positioned against a punch holder. By pre-tensioning the first slide against the second slide, the height of the beam-like element is determined by the position of the first slide and the second slide relative to each other. The pre-tensioning of the first slide against the second slide is additionally advantageous because due to mutual friction due to the pressing of the first slide and the second slide against each other and due to a spigot effect of the sawtooth profiles, the first slide and the second slide do not slide relative to each other in an active state, which could cause the height of the beam-shaped element to change during perforation and undesirably cause certain punches to perforate or not perforate the sheet material.

According to a preferred embodiment, a set of slides comprises a first hydraulic cylinder for moving a second slide of the set of slides according to the second direction. Preferably, the second slide of the set of slides corresponds to the second slide from a previously described embodiment in which a first slide is preloaded against a second slide of a set of slides. The first hydraulic cylinder is arranged according to the second direction at a first end of the second slide. The first hydraulic cylinder comprises a rod that is movable according to the second direction. This embodiment is advantageous because a hydraulic cylinder can reliably apply a large force according to the second direction. This large force is advantageous to overcome friction between saw tooth profiles to slide two slides of a set of slides relative to each other. This is particularly advantageous in a previously described implementation where a first slide is pre-loaded against a second slide of a set of slides.

According to a further embodiment, the first hydraulic cylinder is slidable between at least three positions in the working state by injection or release of a predetermined volume of oil into the first hydraulic cylinder. That the first hydraulic cylinder is slidable between at least three positions means that the piston rod of the first hydraulic cylinder has at least three stable positions, which also determine the three stable positions relative to each other of the two slides of the set of slides. By injection of a first predetermined volume of oil, the piston rod of the first hydraulic cylinder moves from a first position to a second position. By injection of a second predetermined volume of oil, the piston rod moves from the second position to a third position. By release of the second predetermined volume of oil, the piston rod of the first hydraulic cylinder moves from the third position back to the first position and by release of the first predetermined volume of oil from the second position to the first position. It is obvious to a skilled person in the art that by simultaneous injection of both the first predetermined volume of oil and the second predetermined volume of oil, the piston rod of the first hydraulic piston immediately moves from the first position to the third position, just as the piston rod of the first hydraulic piston immediately moves from the third position to the first position by simultaneous release of both the first and second predetermined volume of oil from the first hydraulic cylinder. For example, the first predetermined volume of oil may be injected from a first storage buffer of known volume and the second volume of oil from a second storage buffer of known volume into the first hydraulic cylinder and vice versa.

Preferably, the first hydraulic cylinder is slidable between at least four positions in an operative state. This is particularly advantageous in combination with previously described embodiments in which the slides of a set of slides are slidable between four positions relative to each other. It is obvious to a person skilled in the art that three predetermined volumes of oil are required in this case.

By using a predetermined volume of oil to move the first hydraulic cylinder, it is possible to correctly move the second slide very quickly. The predetermined volume of oil can be injected under high pressure from a storage buffer into the first hydraulic cylinder all at once. Because the volume is predetermined, a distance over which the second slide is slid according to the second direction is by this also known in advance. It is not necessary to gradually inject oil into the first hydraulic cylinder in order to prevent the second slide from being slid too far according to the second direction, thus allowing the second slide to be slid faster.

In this embodiment, it is possible, for example, to slide slides of a set of slides from a first position to a fourth position or vice versa in a time between 80 ms and 100 ms. For a perforating press in which the transmission shaft makes 400 revolutions per minute, a complete cycle takes 150 ms. A punch of a row of punches is in contact with the sheet material for at most 50 ms. This means that 100 ms is left for feeding the sheet material in the first direction and also 100 ms to slide slides from the first position to the fourth position or vice versa. This can be done perfectly, eliminating the need to stop the transmission shaft using a clutch brake to engage or disengage other rows of punches, allowing flexible and optimum throughput of sheet material from an otherwise regular perforation pattern.

According to a preferred embodiment, the set of slides comprises a second hydraulic cylinder. According to the second direction, the second hydraulic cylinder is positioned at a second end of the second slide, lying opposite the first end of the second slide. The second hydraulic exerts a constant pressure against the second end of the second slide when in an active state. The first hydraulic cylinder and the second hydraulic cylinder abut freely against the second slide.

This embodiment is advantageous because the second hydraulic cylinder provides a constant back pressure toward the second end of the second slide. If the piston rod of the first hydraulic cylinder is retracted, the second slide will automatically be pushed back against the piston rod of the first hydraulic cylinder by the constant pressure exerted by the second hydraulic cylinder. If the piston rod of the first hydraulic cylinder is extended, the second slide will be slid toward the second hydraulic cylinder. As a result, it is possible to move the second slide back and forth according to the second direction, by pushing only with the first hydraulic cylinder and not pulling. As a result, it is possible for the first hydraulic cylinder and the second hydraulic cylinder to abut freely against the second slide, without connecting piston rods of the first hydraulic cylinder and the second hydraulic cylinder to the second slide. This allows the first hydraulic cylinder, the second hydraulic cylinder and the set of slides to move relative to each other according to the stroke direction, making it easier to absorb vibrations caused by perforation of the sheet material. There can also be no breaks in connections between the first hydraulic cylinder, the second hydraulic cylinder and the second slide.

According to a preferred embodiment, slides of a set of slides are displaced at least 2 mm and at most 5 mm relative to each other according to the stroke direction between consecutive positions of the at least three positions of the slides.

Preferably the slides of the set of slides are at least 2.5 mm displaced between successive positions, more preferably at least 2.75 mm.

Preferably, the slides of the set of slides are moved at most 4.5 mm displaced between consecutive positions, at more preferably at most 4.25 mm, at even more preferably at most 3.75 mm, and at even more preferably at most 3.5 mm.

Perforations in sheet material have very small dimensions in a plane formed by the sheet material, in some cases dimensions smaller than a thickness of the sheet material. This means that these punches are fragile and preferably have as small a length as possible. By moving the slides of a set of slides at least 2 mm and at most 5 mm between successive positions, it is possible to work with punches of different and yet limited lengths, so that, as described above, a perforation pattern can be flexibly adapted, while the length difference is still large enough so that a perforation is inadvertently not made or an unwanted indentation by a punch in the sheet material is obtained.

According to a preferred embodiment, a spacing between punches of a row of punches is smaller than a spacing between punches of two adjacent rows of punches. Perforations in sheet material are often located very close to each other, for example a grating for a door of a microwave oven. In a regular perforation pattern, this means that a distance between perforations according to the second direction is as small as a distance between successive lines of perforations. If there are deviations in the perforation pattern, for example at the level of a first line or a last line or locally, at least two rows of punches are needed, as previously discussed, to realize these deviations. However, the punch holder cannot be made so small that adjacent lines can also be perforated by adjacent rows of punches. This would cause the punch holder to be insufficiently strong and break due to the vibrations and forces during perforation. By providing several rows of punches positioned at a greater distance from each other, it is possible to execute the punch holder with sufficient strength so that it does not break, and successive lines can be realized at a very small interval at a high speed by using rows of punches to apply lines of perforation between lines of perforation previously applied by other rows of punches positioned closer to the feed medium according to the first direction. The use of four rows of punches allows the application of lines of perforations with smaller spacing at equal speed.

According to an embodiment, the transmission shaft is a camshaft. The camshaft comprises a pointed cam for moving the punch holder. A camshaft is known to an ordinary craftsman. The camshaft translates a rotational motion of the camshaft to a translational displacement in the stroke direction of the punch holder. A camshaft is advantageous for accurately timed displacement of the punch holder. In addition, a camshaft is advantageous for transferring a large thrust force to the punch holder. A large impact force can be transferred faster with a camshaft compared to a punch holder moved with a hydraulic piston.

According to a form of implementation, the transmission shaft is a crankshaft. The crankshaft comprises a crank and a connecting rod for moving the punch holder. The connecting rod connects the crank to the punch holder. A crankshaft is familiar to the average craftsman. The crankshaft translates a rotational motion of the crankshaft to a translational displacement in the stroke direction of the punch holder. A crankshaft is advantageous for transferring a large impact force to the punch holder. A large impact force can be transferred faster with a crankshaft compared to a punch holder moved with a hydraulic piston.

In a second aspect, the invention relates to a method for perforating sheet material.

According to a preferred form of implementation, the process comprises the steps of:

- feed sheet material according to a first direction;
- before perforating the sheet metal, selecting a row of punches comprised in a punch holder;
- perforating the sheet material by moving the punch holder in a stroke direction by a transmission shaft;
- repeat previous steps until a predetermined pattern of perforations is established in the sheet material.

The first direction is preferably a horizontal direction.

The sheet material is supplied as individual sheets according to the first direction. Alternatively, the sheet material is unrolled from a roll, for example a steel roll, and fed according to the first direction. Optionally, in this case the sheet material is cut into individual sheets during feeding. Optionally, in this case the sheet material is flattened after unrolling and before perforation, for example by means of straightening rollers.

The punches are tools suitable for punching sheet material by moving the punch holder in the stroke direction where the punches are pushed through the sheet material. The punches comprised in a punch holder are preferably aligned according to the second direction. The punch holder preferably extends over the full width of the sheet material being fed.

The punches of a row of punches comprised in the punch holder are selected by sliding two slides of a set of slides relative to each other in a second direction. The second direction is transverse to the first direction. The second direction is preferably a horizontal direction. The set of slides is positioned between the row of punches and the transmission shaft for moving the punch in the stroke direction. The stroke direction is transverse to the first direction and the second direction. Preferably, the stroke direction is a vertical direction.

A slide is beam-shaped. The beam shape extends according to a length direction, a width direction and a height direction. The beam shape has a greatest dimension according to the length direction. The length direction of the beam form corresponds to the second direction. A slide comprises on a first side a sawtooth profile at least partially continuous according to the second direction. A tooth of the sawtooth profile has two sides with a different slope. The sawtooth profile is similar to the profile of a northlight roof. The two slides of a set of slides are positioned with their sawtooth profiles on top of each other slidably relative to each other according to the second direction. As the two slides of a set of slides are arranged with their saw tooth profiles facing each other and placed on top of each other, a beam-shaped element with a certain height is obtained. By sliding the two slides relative to each other, the height of the beam-shaped element is adjusted. The height is according to the stroke direction. Depending on the height of the beam-shaped element formed by the set of slides, the punches are moved further or less far according to the stroke direction toward the sheet material, which determines whether or not a punch is pushed through the sheet material and the sheet material is perforated by the punches or not.

When perforating the sheet material, at least four rows of punches are moved simultaneously according to the stroke direction, each row of punches comprising at least two punches. The slides of at least one set of slides related to any one row of punches are slid between at least three positions relative to each other during the application of the predetermined pattern of perforations in the sheet material independently of the slides of a set of slides related to any other row of punches. That a set of slides is related to a row of punches means that the set of slides is positioned between the transmission shaft and the row of punches according to the stroke direction, and that the row of punches is moved in the stroke direction by the transmission shaft with the punch holder using said set of slides. That slides of a set of slides are slidable between at least three positions means that the two slides of a set of slides have at least three stable positions relative to each other.

After perforating the sheet material, the rows of punches again move away from the sheet material according to the stroke direction, after which the previous steps are performed again by feeding sheet material by moving the sheet material, preferably over a fixed predetermined distance, selecting punches in the at least four rows of punches and moving the rows of punches in the stroke direction by the transmission shaft.

One of the advantages of this method is that very many variations of perforation patterns can be applied to the sheet material and that a very flexible local deviation from an otherwise regular perforation pattern can be made, as it is possible to switch rows of punches on and off independently of each other. By using punches of different lengths, it is possible to deviate from the perforation pattern even within one line. For example, in a row of punches, punches of two different lengths are used, where in a first position relative to each other of the two slides of the set of slides, related to said row of punches, all punches comprised in the row of punches perforate the sheet material, where in a second position relative to each other of said two slides, only punches comprised in the row of punches of greatest length perforate the sheet material, and where in a third position relative to each other of said two slides, no punches comprised in the row of punches perforate the sheet material. In the third position, the entire row of punches is disabled. An additional advantage of the method is that the use of at least four rows of punches allows successive lines of a perforation pattern to be applied very close together.

According to a preferred embodiment, slides of at least one set of slides related to any one row of punches are displaced independently of the slides of a set of slides related to any other row of punches between at least four positions relative to each other during the application of the predetermined pattern of perforations in the sheet material. This is advantageous in that it allows, in one row of punches, punches of three different lengths to be used, thereby providing more flexibility to deviate from an otherwise regular pattern of perforations within a single line. Preferably, the row of punches to which the at least one set of slides is related comprises at least three punches of different lengths.

According to a preferred embodiment, a second slide of a set of slides is slid according to the second direction using a first hydraulic cylinder, whereby a predetermined volume of oil is injected into or released from the first hydraulic cylinder. The second slide is preferably the slide facing a transmission shaft. A first slide of the set of slides is preferably a slide positioned against a row of punches.

By using a predetermined volume of oil to move the second slide, it is possible to move the second slide correctly very quickly. The predetermined volume of oil can be injected under high pressure from a storage buffer into the first hydraulic cylinder all at once. Because the volume is predetermined, a distance over which the second slide is advanced according to the second direction is also known in advance. It is not necessary to gradually inject oil into the first hydraulic cylinder in order to prevent the second slide from being advanced too far according to the second direction, thus allowing the second slide to be advanced faster.

According to a further embodiment, a second hydraulic cylinder presses against the second slide of a set of slides according to the second direction with a constant pressure. Both the first hydraulic cylinder and the second hydraulic cylinder abut freely against the second slide.

This embodiment is advantageous because the second hydraulic cylinder provides constant back pressure. If a piston rod of the first hydraulic cylinder is retracted, the second slide will automatically be pushed back against the piston rod of the first hydraulic cylinder by the constant pressure exerted by the second hydraulic cylinder. If the piston rod of the first hydraulic cylinder is extended, the second slide will be slid toward the second hydraulic cylinder. As a result, it is possible to move the second slide back and forth according to the second direction, by pushing only with the first hydraulic cylinder and not pulling. As a result, it is possible for the first hydraulic cylinder and the second hydraulic cylinder to abut freely against the second slide, without connecting piston rods of the first hydraulic cylinder and the second hydraulic cylinder to the second slide. This allows the first hydraulic cylinder, the second hydraulic cylinder and the set of slides to move relative to each other according to the stroke direction, making it easier to absorb vibrations caused by perforation of the sheet metal. There can also be no breaks in connections between the first hydraulic cylinder, the second hydraulic cylinder and the second slide.

According to a preferred embodiment, the relative sliding of slides of a set of slides from a first extreme position to a second extreme position takes at most 100 ms. A first extreme position is a position in which the beam-shaped element formed by the two slides of a set of slides has a maximum height according to the stroke direction. A second extreme position is a position in which the beam-shaped element formed by the two slides of a set of slides has a minimum height according to the stroke direction.

This embodiment is advantageous because if the transmission shaft makes 400 revolutions per minute, a full cycle takes 150 ms. A punch of a row of punches is in contact with the sheet material for at most 50 ms. This means that 100 ms is left for feeding the sheet material in the first direction and also 100 ms to move slides from a first extreme position to a second extreme position, or vice versa. This can be done perfectly, eliminating the need to stop the transmission shaft using a clutch brake to engage or disengage other rows of punches, allowing flexible and optimal throughput of sheet material from an otherwise regular perforation pattern.

A person skilled in the art will appreciate that a method according to the second aspect is preferably performed using a perforating press according to the first aspect and that a perforating press according to the first aspect is preferably configured to perform a method according to the second aspect. Accordingly, each feature described herein, above as well as below, may relate to any of the three aspects of the present invention.

In a third aspect, the invention relates to a use of a perforating press according to the first aspect or a process according to the second aspect for manufacturing grilles for household appliances.

This use results in inexpensive manufacture of grilles for household appliances, such as, for example, grilles in microwave oven doors, grilles over a drain in dishwashers or cooling grilles in computer casings, for example. In household appliances, grilles often incorporate decorative elements, such as, for example, a logo or a variation in density in perforations. The use of a perforating press according to the first aspect or a method according to the second aspect allows to performantly realize a large variety of perforation patterns or to deviate locally from an otherwise regular perforation pattern, for example for a logo. These grids also often have a very small gap between successive lines of a perforation pattern, which is perfectly possible by using four rows of punches.

The invention claimed is:

1. Perforating press for perforating sheet material comprising a feeding device for feeding sheet material in a first direction; a punch holder, wherein the punch holder comprises a first row of punches and a second row of punches, wherein the first row of punches and the second row of punches extend in a second direction transverse to the first direction, and wherein the first row of punches and the second row of punches each comprise at least two punches; a transmission shaft for moving the punch holder in a stroke direction, transverse to the first direction and transverse to the second direction, wherein a set of slides is positioned between each row of punches, comprised in the punch holder, and the transmission shaft, wherein each set of slides comprises two slides, wherein each slide of each set of slides is beam-shaped and extends according to the second direction, wherein each slide comprises on a first side a sawtooth profile at least partially continuous according to the second direction, wherein the two slides of each set of slides are positioned with their sawtooth profiles slidably engaged with respect to each other according to the second direction; and a discharge means for discharging perforated sheet material, wherein the punch holder comprises a third row of punches and a fourth row of punches, wherein the third row of punches and the fourth row of punches extend in the second direction, and wherein the third row of punches and the fourth row of punches each comprise at least two punches, and wherein the slides of each set of slides related to any one row of punches are slidable between at least three positions relative to each other independently from the slides of each other set of slides related to any other row of punches.

2. Perforating press according to claim 1, wherein the slides of each set of slides are slidable between four positions relative to each other.

3. Perforating press according to claim 2, wherein at least one of the rows of punches comprises at least three punches each having a different length, wherein the length of a punch is measured according to the stroke direction from a same surface of the punch holder to a free end of the punch.

4. Perforating press according to claim 1, wherein a first slide of each set of slides is pre-stressed against a second slide of each set of slides by means of springs.

5. Perforating press according to claim 1, wherein each set of slides comprises a first hydraulic cylinder for moving a second slide of each set of slides according to the second direction, wherein the first hydraulic cylinder being positioned at a first end of the second slide according to the second direction.

6. Perforating press according to claim 5, wherein the first hydraulic cylinder is in working state slidable between at least three positions by injection or release of a predetermined volume of oil in the first hydraulic cylinder.

7. Perforating press according claim 5, wherein each set of slides comprises a second hydraulic cylinder, wherein the second hydraulic cylinder is positioned according to the second direction at a second end of the second slide, lying opposite the first end of the second slide, wherein the second hydraulic cylinder exerts in a working state a constant pressure against the second end of the second slide, and wherein the first hydraulic cylinder and the second hydraulic cylinder abut freely against the second slide.

8. Perforating press according to claim 1, wherein the slides of each set of slides are displaced at least 2 mm and at most 5 mm relative to each other according to the stroke direction between consecutive positions of the at least three positions of the slides.

9. Perforating press according to claim 1, wherein a mutual distance between punches of a row of punches is smaller than a mutual distance between punches of two adjacent rows of punches.

10. Method for perforating sheet material comprising:

feed sheet material according to a first direction;

before perforating the sheet material, selecting a row of punches of at least four rows of punches comprised in a punch holder by sliding two slides of a set of slides relative to each other in a second direction, transverse to the first direction, wherein the set of slides is positioned between the row of punches and a transmission shaft for moving the punch holder in a stroke direction, transverse to the first direction and the second direction;

perforating the sheet material by moving the row of punches, comprised in the punch holder, in the stroke direction by the transmission shaft;

repeat previous steps until a predetermined pattern of perforations is applied in the sheet material, wherein, when perforating the sheet material, the at least four rows of punches are moved simultaneously according to the stroke direction, each row of punches comprising at least two punches, and wherein the slides of at least one set of slides related to any row of punches are slid independently of the slides of each other set of slides related to any other row of punches between at least three positions relative to each other during the application of the predetermined pattern of perforations in the sheet material.

11. Method according to claim 10, wherein the slides of at least one set of slides related to any one row of punches are slid independently of the slides of each other set of slides related to any other row of punches between at least four positions relative to each other during the application of the predetermined pattern of perforations in the sheet material.

12. Method according to claim 10, wherein a second slide of each set of slides is slid according to the second direction using a first hydraulic cylinder, wherein a predetermined volume of oil is injected into the first hydraulic cylinder or is released from the first hydraulic cylinder.

13. Method according to claim 12, wherein a second hydraulic cylinder presses against the second slide of a set of slides according to the second direction with a constant pressure, both the first hydraulic cylinder and the second hydraulic cylinder abutting freely against the second slide.

14. Method according to claim 10, wherein the relative sliding of slides of each set of slides from a first extreme position to a second extreme position takes at most 100 ms.

15. Use of a perforating press of claim 1 for the manufacture of grilles for household appliances.

* * * * *